US005207842A

United States Patent [19]

Guerlet et al.

[11] Patent Number: 5,207,842

[45] Date of Patent: May 4, 1993

[54] MATERIAL BASED ON SILVER AND TIN OXIDE FOR THE PRODUCTION OF ELECTRICAL CONTACTS; ELECTRICAL CONTACTS THUS PRODUCED

[75] Inventors: Jean-Paul Guerlet, Paris; Dan Weber, Presles; Sophie Coupez, Paris; Claude Lambert, Saint-Witz, all of France

[73] Assignee: Comptoir Lyon-Alemand Louyot, France

[21] Appl. No.: 602,916

[22] Filed: Oct. 23, 1990

Related U.S. Application Data

[63] Continuation of Ser. No. 332,705, Apr. 3, 1989, abandoned.

[30] Foreign Application Priority Data

Mar. 10, 1989 [FR] France ..... 89 03182

[51] Int. Cl.[5] ..... C22C 5/06

[52] U.S. Cl. ..... 148/431; 428/614; 200/266; 75/234

[58] Field of Search ..... 420/501, 502; 75/234; 148/430, 431, 284; 428/614; 200/266

[56] References Cited

U.S. PATENT DOCUMENTS

| | | | |
|---|---|---|---|
| Re. 30,052 | 7/1979 | Davies et al. | 75/234 |
| 4,131,458 | 12/1978 | Satoh et al. | 148/431 |
| 4,636,270 | 1/1987 | Shibata | 148/431 |

FOREIGN PATENT DOCUMENTS

| | | |
|---|---|---|
| 51-121795 | 10/1976 | Japan . |
| 52-033067 | 3/1977 | Japan . |

*Primary Examiner*—R. Dean
*Assistant Examiner*—Margery Phipps
*Attorney, Agent, or Firm*—Mark T. Basseches

[57] ABSTRACT

The present invention relates to novel materials based on silver and tin oxide for the production of electrical contacts as well as the electrical contacts thus produced. According to the invention, these materials contain at least 6% by weight of tin oxide and from 0.02 to 5% by weight of tellurium oxide; the total content by weight of metal oxides, with the exclusion of tellurium oxide, does not exceed 15%, the balance being made up by silver. Application: manufacture of electrical equipment.

15 Claims, No Drawings

MATERIAL BASED ON SILVER AND TIN OXIDE FOR THE PRODUCTION OF ELECTRICAL CONTACTS; ELECTRICAL CONTACTS THUS PRODUCED

This is a continuation of Ser. No. 332,705, filed Apr. 03, 1989, now abandoned.

The subject of the present invention is novel materials based on silver and tin oxide for the production of electrical contacts.

For many years, the materials most widely used in low voltage electrical appliances were constituted mainly of silver and cadmium oxide. These materials were usually produced by internal oxidation, but also by powder metallurgy.

However, in view of the environmental problems associated with the toxicity of cadmium, there has been a move toward the investigation of new materials in which cadmium oxide is replaced by other oxides which do not pollute the environment.

In this way, it has been discovered that materials based on silver and tin oxide are attractive substitutes. In fact, the use of such materials makes it possible to eliminate the problems associated with pollution of the environment and the electrical contacts developed with the aid of such materials possess a resistance to erosion by the electric arc which is very markedly improved in comparison with that of conventional materials made of silver-cadmium oxide. This results in an appreciable increase in the life of the appliances in which such contacts are used.

The higher thermal stability of tin oxide, compared to that of cadmium, explains its favorable properties with respect to erosion by the electric arc.

However, the contacts constructed with the aid of materials based on silver and tin oxide possess two major disadvantages with respect to their electrical performance:

on the one hand, the formation of a layer of oxide on the surface is observed after several thousand switching operations which causes the contact resistance to increase to excessively high values leading to considerable rises in temperature which could damage the equipment;

on the other hand, the power required to break the soldering points between the contacts after passage of the current is markedly higher than for materials based on silver and cadmium oxide.

Many investigations have thus been made with the intention of overcoming these disadvantages, and the suggestion has been made in particular that the materials based on silver and tin oxide be supplemented with other oxides.

Thus, the document EP-0024349 describes the use of tungsten oxide $WO_3$ as additional oxide for remedying the tendencies to heating up and reducing the soldering strengths of the contact materials made of silver and tin oxide.

The document EP-0039429 also suggests the addition of bismuth oxide $Bi_2O_3$.

Similarly, the document EP-0056857 teaches that it is possible to reduce the heating up phenomena and the values of soldering strength by addition of molybdenum oxide $MoO_3$ and/or germanium oxide $GeO_2$.

However, the addition of molybdenum oxide induces a considerable degree of brittleness in the material thus obtained and fracturing phenomena in particular are observed in contacts made with these materials when they are subject to thermal constraints created by the electric arc after several thousand switching operations.

Moreover, the high cost of germanium oxide considerably reduces interest in its industrial use.

The subject of the present invention is to resolve the technical problem and consists in supplying a novel material based on silver and tin oxide enabling electrical contacts to be manufactured which exhibit a low rise in temperature and a reduced value of soldering strengths while maintaining a resistance to erosion by the electric arc higher than that of the conventional materials made of silver and cadmium oxide.

In conformity with the present invention, the solution for resolving this technical problem consists of a material for the production of electrical contacts composed of silver, tin oxide and one or more other metal oxides, characterized in that it comprises at least 6% and preferably 9 to 13% by weight of tin oxide, and 0.02 to 5%, and preferably 0.5 to 2% by weight of tellurium oxide; the total content by weight of metal oxides, with the exclusion of tellurium oxide, does not exceed 15%, the balance being made up with silver.

In fact, it has been discovered in a quite surprising and unexpected manner that the addition of tellurium oxide to silver-tin oxide materials containing at least 6% by weight of tin oxide enabled materials to be produced exhibiting considerably reduced soldering strengths, and which maintain a satisfactory resistance to erosion by the electric arc. The invention is thus based on this discovery.

The materials corresponding to the invention can be prepared by the different methods known for the preparation of materials based on silver and at least one metal oxide. These methods comprise in particular internal oxidation, powder metallurgy or mixed techniques such as internal oxidation of alloys in powder form, followed by conventional manufacture by means of powder metallurgy.

However, it has been observed that internal oxidation of materials based on silver and tin does not easily give rise to materials containing more than 6% by weight of tin oxide. In fact, since the rate of diffusion of tin into the silver is higher than the rate of diffusion of oxygen into the silver, a layer of tin oxide is formed on the surface during the oxidation step and this is not the intended aim of the treatment.

Nonetheless, alloys in conformity with the invention can be prepared:

either by working under an oxygen pressure of 1 to 5 MPa (i.e. about 10 to 50 bars), or by using as starting materials silver-tin-tellurium compounds to which are added elements such as indium or bismuth, and those for which internal oxidation can occur when a lower oxidation pressure is used (for example 0.1 MPa).

It is also possible to manufacture the materials corresponding to the invention by a mixed technique such as the internal oxidation of alloys in powder form. In this case, the starting material (to which indium or bismuth may be added if required) is melted and converted in order to produce a powder which is oxidized. This oxidized powder is then treated by compression and sintering according to a standard method of powder metallurgy. This type of method is used in particular when the kinetics of oxidation are slow, which would require very long oxidation times if the material were in bulk form.

The materials corresponding to the invention are preferably produced by powder metallurgy.

Generally speaking, a prior thermal treatment involving calcination of pure tin oxide is carried out in order to produce a mild sintering of the powder.

The presintered tin oxide is then ground finely and mixed mechanically in the dry state with the silver powder and the powder of tellurium oxide $TeO_2$ and, if necessary, the powder of an additional metal oxide in the desired proportions in order to produce a fine and even dispersion of the oxides in the silver.

The contact material is then prepared either by compression and sintering of unit elements, or by conversion by extrusion or rolling of sintered roughcasts.

It is possible to promote the operation of prior presintering of the tin oxide by means of an activator, in particular copper oxide CuO, for example in an amount of about 1% by weight of the weight of tin oxide.

Thus, in accordance with a particular feature, the materials corresponding to the invention contain from 0.06 to 0.2% by weight of copper oxide.

The materials presently preferred for the production of electrical contacts are those composed of silver, tin oxide, tellurium oxide and, if required, copper oxide.

However, tests have shown that the presence of additional metal oxides introduced as a substitute for a part (up to about 30%) of the tin oxide, for example to promote the preparation of materials by internal oxidation (in the case of indium oxide or bismuth oxide) or in the case of the preparation of materials by powder metallurgy (in the case of indium oxide, bismuth oxide or zinc oxide) does not lead to appreciable modifications of the properties of these materials compared with materials not containing such additional oxides but having the same percentages by weight of silver, tellurium oxide and, if required, copper oxide.

Consequently, and herein lies the originality of the present invention, it is the utilization of tellurium oxide as additive in the materials based on silver and tin oxide which has led to the results being achieved which were set out as the intended goals of the invention.

In accordance with a second feature, the present invention relates to electrical contacts produced with the aid of the materials described previously.

The invention will be illustrated in more detail by the following, non-limiting examples of the range of the invention. In these examples all percentages are given by weight, unless indicated otherwise.

EXAMPLE 1

A powder of tin oxide of particle size less than 1 μm is calcinated for 1 h at 1400° C. in a neutral atmosphere so as to give rise to mild sintering of the tin oxide, which is then finely ground. This presintering operation applied to $SnO_2$ is intended to improve the densification of the material when it is subsequently subjected to a sintering treatment. The tin oxide thus treated is then mixed mechanically in the dry state with silver powder of particle size between 5 and 10 μm, and a powder of tellurium oxide $TeO_2$ in proportions, expressed in percentages by weight, of 87% of Ag, 12% of $SnO_2$ and 1% of $TeO_2$. The entire powder mixture thus obtained is then compressed to a density of 6.7, sintered for 1 h at 900° C. in air and recompressed under high pressure to its maximal density so as to give rise to pellets 8 mm in diameter and 2 mm thick comprising an underlayer of silver 300 μm thick which can be soldered.

These pellets are then soldered on supports made of copper and mounted on a testing device which measures the erosion by the electric arc when the circuit is switched on. For medium currents, this device is powered by an alternating voltage of 230 V, 50 Hz, and a test current of 100 A, for a powder factor of 1.

Under these conditions, the erosion produced after 20,000 switchings of the testing device, at a frequency of one switching operation per second, is 13.2 mg. A reference material consisting of silver-cadmium oxide produced by internal oxidation gave an erosion of 50 mg under the same conditions.

The rise in temperature of the fixed contact support was measured using the same device.

When the testing device has attained thermal equilibrium, the material of example 1 causes the temperature of the contact support to rise by 50° C., whereas the reference material causes a temperature rise of about 53° C. This rise in temperature is a function of the Joule effect caused by the passage of the current when the contacts are closed and also of the energy dissipated by the electric arcs when switched on. Consequently, these results show that the material corresponding to the invention is comparable to the reference material with respect to its tendencies to heat up.

EXAMPLE 2

By following the procedure described in example 1 different materials have been prepared which have the following compositions:

| |
|---|
| Ag 87.8% / $SnO_2$ 12% / $TeO_2$ 0.2% |
| Ag 87.5% / $SnO_2$ 12% / $TeO_2$ 0.5% |
| Ag 87% / $SnO_2$ 12% / $TeO_2$ 1% |
| Ag 86% / $SnO_2$ 12% / $TeO_2$ 2% |

These materials are prepared in the form of pellets 5 mm in diameter and 2 mm thick containing a 300 μm underlayer of silver capable of being soldered. These pellets are then soldered onto copper supports and mounted on a testing device which measures erosion by the electric arc, the soldering strength and the temperature rise of the contact pieces. The test contacts cause the switching on and off of an electric circuit powered by an alternating voltage of 230 V, 50 Hz and carrying a current of 200 A, the load circuit being constituted of pure resistances. The results shown are derived from values measured at each test switching operation. For this purpose the mean value, the maximum value and the percentage of switching operations which produced a soldering strength higher than 15N are calculated.

In the present example, the reference material is a Ag—$SnO_2$ material containing 12% by weight of $SnO_2$. It is compared with the four materials of example 2 which contain amounts of tellurium oxide increasing from 0.2% to 2%.

The results which are assembled in table I quite surprisingly show that the materials doped with tellurium oxide prepared according to the invention possess soldering strengths appreciably lower, i.e. about 2 to 3 times lower, than those which are obtained with the non-doped reference material. The results also show that the frequency of the test switching operations for which the welding force is higher than 15N may be up to 10 times lower for the materials doped with tellurium oxide according to the invention than for the reference material which does not contain a dopant.

The results also show that the resistance to erosion by the electric arc is slightly less good for the materials doped with tellurium oxide according to the invention than that of a non-doped reference material. This is however not a disadvantage since it can be seen on micrographic sections carried out on the contact pieces after the tests that the erosion of the materials according to the invention is not accompanied by the appearance of fractures in the metal matrix as occurs with the non-doped reference material or even with the doped materials of the prior art.

EXAMPLE 3

A thermal treatment is carried out at 1150° C. for one hour in air on a mixture containing 99% by weight of $SnO_2$ powder and 1% by weight of copper oxide powder $Cu_2O$. Copper oxide is well known to be one of the most effective activators of sintering of tin oxide. The addition of copper oxide thus makes it possible to reduce the temperature of the presintering treatment of the pure tin oxide considerably. Many results have been published on this subject, for example in scientific communications such as:

W. RIEGER, Application of Tin Oxide in Glass Melting, International Conference: Properties and uses of inorganic tin chemicals, Bruxelles, 1986.

G. B. SHAW, Properties of Tin Oxide Electrodes for Glass Industry, International Conference: Properties and use of inorganic tin chemicals, Bruxelles 1986.

D. WEBER, C. LAMBERT, B. LE BOUGUENEC, J. P. GUERLET, Influence of Additives on Sintering and Electrical behavior of silver/Tin Oxide materials, Electric contacts, Paris 1988.

The $SnO_2$—CuO mixture is thus presintered then finely ground and mixed mechanically with silver powder and tellurium oxide powder $TeO_2$ in proportions, expressed as percentages by weight, of 86% of Ag, 12% of the $SnO_2$—CuO mixture and 2% of $TeO_2$. The material is then prepared in the form of contact pellets according to the method of compression and sintering described in example 1.

These pellets, 8 mm in diameter and 2 mm thick are then soldered onto copper supports and mounted on a testing device which simulates the functioning of a contactor. This testing device functions in accordance with the recommendation given in the brochure NF C 63-101 "Tests of contact materials for low voltage control equipment" and it enables the materials to be characterized under conditions similar to those of the category AC3 used for the contactors defined in the standard NF C 63-110 published by L'Union Technique de l'Electricite. The nominal current is 100 A, i.e. the contacts tested are subjected to a current of 600 A at the closing and of 100 A at the opening of the circuit.

In the tables 2, 3 and 4 which represent the results of the electrical tests, these values are designated by nI for nominal intensity and KnI for intensity at closure.

A test consists of carrying out 10,000 switching operations under these conditions at a frequency of one switching operation every 2 seconds. The device measures erosion, heating up, contact resistance and soldering strength. As far as the soldering strengths are concerned, the useful results are derived from values measured at each of the 10,000 switching operations: the mean value, the maximal value and the percentage of switching operations which produced a soldering strength higher than 15N are thus calculated.

A reference material Ag—$SnO_2$ 88/12 is prepared by following the same procedure.

The results of these experiments are assembled in table 2.

The material of the example was also tested on the above device but with a nominal current intensity of 25 A, i.e. an excess current at the closing of the contacts of 150 A. In this test, the contacts were subjected to 10,000 switching operations at a rate of one switching operation every second. The results are shown in Table 3.

EXAMPLE 4

By following the experimental protocol described in example 3, a material was prepared, the composition of which, expressed in percent by weight, was 87% silver, 12% tin oxide doped with 1% of copper oxide, and 1% tellurium oxide.

This material was then tested on the device used in example 3 under the same two conditions of current intensity as for example 3.

The results obtained at a nominal intensity of 100 A are shown in Table 2, whereas the results obtained with an intensity of 25 A are shown in Table 3.

EXAMPLE 5

The material described in example 1: Ag 87%, $SnO_2$ 12%, $TeO_2$ 1% was tested under the conditions defined in example 4.

In the Tables 2 and 3, the materials prepared according to the invention are compared with a material made of Ag—$SnO_2$ containing 12% by weight of $SnO_2$ under the two conditions of current intensity previously defined. It is observed that the materials doped with tellurium oxide exhibit soldering strengths which may be from 2 to 3 times weaker in terms of the mean value and the maximal value than those for the reference material Ag—$SnO_2$ 88/12 which does not contain tellurium oxide.

In the case of the test carried out at a nominal current intensity of 100 A, the number of switching operations which produced a strength higher than 15N may be up to 5 times lower for the materials doped with tellurium oxide than for the reference material.

The results also show that, on the testing device referred to, the resistance to corrosion by the electric arc of the materials according to the invention is equivalent to that of the reference material.

Results of the same type were obtained with materials similar to those described in example 1 to 4 prepared by substituting one or more oxides such as indium oxide ($In_2O_3$), bismuth oxide ($Bi_2O_3$), zinc oxide for a part of the tin oxide.

Further test have led to the determination that the materials meeting the desired objectives are those containing at least about 6% by weight of tin oxide and from 0.02 to 5% by weight of tellurium oxide and their total content by weight of metal oxides, with the exclusion of tellurium oxide, does not exceed 15%.

EXAMPLE 6 (Preferred embodiment)

A thermal treatment is carried out for one hour at 1150° C. in air on a mixture containing 99% by weight of $SnO_2$ powder and 1% by weight of copper oxide powder.

The $SnO_2$—$Cu_2O$ mixture thus presintered is then finely ground so as to produce a powder with a particle size of the order of 3 μm. This powder is then mixed mechanically in the dry state with silver powder and the powder of tellurium oxide $TeO_2$ in the proportions, expressed in percent by weight, of 88% of silver, 10% of tin oxide doped with copper The material with the composition Ag 88%/$SnO_2$ 9.89%/CuO 0.11%/$TeO_2$ 2% is then prepared in the form of contact pellets 8 mm in diameter and 2 mm thick containing an underlayer of silver which can be soldered according to the procedure of compression and sintering described in example 1.

The material of the example was tested in the device described in example 3, but with a nominal current intensity of 175 A, i.e. an excess current at the closure of the contacts of 1050 A. In this test, the contacts are subjected to 10,000 switching operations at a rate of one switching operation every 3 seconds, and a comparison is made with a material made of Ag—$SnO_2$ containing 12% of tin oxide, tested under the same conditions. The results obtained are shown in Table 4.

It can be seen that the material of the example possesses soldering strengths very markedly lower than the non-doped reference material: the mean value of the soldering strengths assessed for 10,000 switching operations is 4 times less, whereas the number of switching operations which produced a soldering strength higher than 15N is 9 times lower for the material of the example prepared according to the invention than for the reference material.

The results also show that, under the test conditions referred to, the resistance to erosion by the electric arc and the heating up effect are equivalent for the reference material and for the material of the example.

All of the results of examples 1 to 6 given above and additional tests which were carried out show very clearly that the utilization of tellurium oxide as additive in the materials based on silver and tin oxide has led to the results being achieved which were set out as the intended goals of the invention.

These results are also obtained when one part of the tin oxide is replaced by another metal oxide such as indium oxide, bismuth oxide or zinc oxide.

Finally, it has been observed, particulary in the case of the results of example 6, that the finely divided state of the tin oxide and its state of dispersion in the silver are factors which have a very favorable influence on the behavior of the material.

TABLE 1

ELECTRICAL TEST 200 A
CONTACT DIMENSIONS: ∅ 5 mm, Thickness 2 mm

| MATERIAL | Erosion µg/ switching operation | Soldering strength N mean value | N maximal value | % of strengths >15 N | Rise in temperature °C. |
|---|---|---|---|---|---|
| Ag $SnO_2$ 88/12 | 1,64 | 2,87 | 51,7 | 3,47 | 6 |
| Ag 87,8%/$SnO_2$ 12%/$TeO_2$ 0,2% | 4,3 | 1,58 | 38,2 | 0,81 | 9,65 |
| Ag 87,5%/$SnO_2$ 12%/$TeO_2$ 0,5% | 4,2 | 1,62 | 32,4 | 0,91 | 9,12 |
| Ag 87%/$SnO_2$ 12%/$TeO_2$ 1% | 4 | 1,10 | 28,1 | 0,39 | 9,95 |
| Ag 86%/$SnO_2$ 12%/$TeO_2$ 2% | 2,81 | 1,1 | 23,03 | 0,35 | 10,74 |

TABLE 2

ELECTRICAL TESTS - nI = 100 A
KnI = 600 A
CONTACT DIMENSIONS: ∅ 8 mm, Thickness 2 mm

| MATERIAL | Erosion after 10,000 switching operations in mg | Soldering strength, in N Mean | Maximal value | % of strengths >15 N | Mean cR in mΩ | Rise in temperature °C. |
|---|---|---|---|---|---|---|
| Ag $SnO_2$ 88/12 | 262 mg | 2,2 | 62,3 | 1,88 | 2,6 | 38,5 |
| Ag 87% $SnO_2$ 12% $TeO_2$ 1% | 204 mg | 2,04 | 52,6 | 0,75 | 0,55 | 32,2 |
| Ag 86%/$SnO_2$ 11,87% CuO 0,13% $TeO_2$ 2% | 302 mg | 1,93 | 29,2 | 0,34 | 1,34 | 36,5 |
| Ag 87%/$SnO_2$ 11,87% CuO 0,13%/$TeO_2$ 1% | 274 mg | 2,10 | 46,2 | 0,46 | 0,95 | 31,4 |

TABLE 3

ELECTRICAL TESTS - nI = 25 A
KnI = 150 A
CONTACT DIMENSIONS: ∅ 8 mm, Thickness 2 mm

| MATERIAL | Mean erosion in µg/ switching operations | Soldering strength, in N Mean | Maximal value | % of strengths >15 N | Mean cR in mΩ | Mean rise in temperature °C. |
|---|---|---|---|---|---|---|
| Ag $SnO_2$ 88/12 | 2,00 | 0,35 | 14,17 | — | 1,34 | 14,40 |
| Ag 87% $SnO_2$ 12% $TeO_2$ 1% | 1,55 | 0,11 | 12,2 | — | 1,79 | 15,34 |
| Ag 87% $SnO_2$ 11,87% CuO 0,13% $TeO_2$ 1% | 2,31 | 0,15 | 6,69 | — | 2,38 | 13,10 |
| Ag 86% $SnO_2$ 11,87% CuO 0,13% $TeO_2$ 2% | 1,79 | 0,15 | 4,19 | — | 3,99 | 17,04 |

TABLE 4

ELECTRICAL TESTS - nI = 175 A
KnI = 1050 A
CONTACT DIMENSIONS: ø 8 mm, Thickness 2 mm

| MATERIAL | Erosion after 10,000 switching operations in mg | Soldering strength, in N | | | | Mean cR in mΩ | Rise in temperature °C. |
|---|---|---|---|---|---|---|---|
| | | Mean | Maximal value | Mean/max.* | % of strengths >15 N | | |
| Ag $SnO_2$ 88/12 | 587,9 | 8,67 | 62,8 | 60,7 | 16,6 | 1,08 | 47,2 |
| Ag 88%/$SnO_2$ 9,89%/CuO 0,11%/$TeO_2$ 2% | 609,1 | 2,17 | 53,86 | 32,5 | 1,89 | 2,62 | 51,2 |

*mean/max.: mean of the maximal soldering strengths recorded over intervals of 500 switching operations.

We claim:

1. Material for electrical contacts, consisting essentially of silver in the amount of at least 80% by weight, tin oxide in an amount of from 9 to 13% by weight, and tellurium oxide in an amount of from 0.02 to 5% by weight and one other metal oxide selected from the group consisting of indium oxide, zinc oxide and copper oxide in an amount of from 0.06 to 0.2% by weight, the combined amount of tin oxide and said other metal oxide in this material shall not exceed 15% by weight, the oxides being evenly dispersed in the silver.

2. The material of claim 1 which contains copper oxide as the other metal oxide in an amount of from 0.06 to 0.2% by weight.

3. Electrical contacts made of the material of claim 1.

4. Material according to claim 1, wherein it is prepared by powder metallurgy.

5. Electrical contacts made of the material of claim 4.

6. Material according to claim 1, which is prepared by powder metallurgy techniques.

7. Material according to claim 7, which contains 1% by weight of tellurium oxide.

8. Material according to one of the claims 6 or 7, which contains copper oxide as the other metal oxide in an amount of from 0.06 to 0.2% by weight.

9. Material composed of 88% silver, 10.88% tin oxide, 0.12% copper oxide, and 1% tellurium oxide, expressed by weight.

10. Electrical contacts made of the material of claim 9.

11. Material composed of 88% silver, 9.89% tin oxide, 0.11% copper oxide and 2% tellurium oxide, expressed by weight.

12. Electrical contacts made of the material of claim 11.

13. Material for electrical contacts, consisting essentially of silver, in the amount of 80% by weight, tin oxide, in an amount of greater than 10% by weight and not more than 13% by weight, tellurium oxide, in an amount of from 0.02 to 5% by weight, and at least one other metal oxide selected from the group consisting of indium oxide, zinc oxide and copper oxide, in an amount of from 0.06 to 0.2% by weight, the combined amount of tin oxide and said other metal oxide being less than 15% by weight, the oxides being evenly dispersed in the silver, said material being prepared from a mixture consisting essentially of finely divided metallic silver and the metal oxide, by powder metallurgy techniques.

14. Material for electrical contacts, consisting essentially of silver in the amount of at least 80% by weight, tin oxide in an amount of from 9 to 13% by weight, and tellurium oxide in an amount of from 0.02 to 5% by weight and copper oxide in an amount of from 0.06 to 0.2% by weight, the oxide being evenly dispersed in the silver.

15. Material composed of 87% silver, 12% tin oxide and 1% tellurium oxide, expressed by weight.

* * * * *